United States Patent [19]

Inoue et al.

[11] Patent Number: 4,954,404

[45] Date of Patent: Sep. 4, 1990

[54] DEVELOPING METHOD AND DEVICE AND COLOR IMAGE FORMING METHOD AND APPARATUS USING SAME

[75] Inventors: Masahiro Inoue, Yokohama; Hatsuo Tajima, Matsudo; Yuji Sakemi; Kenji Okado, both of Yokohama, all of Japan

[73] Assignee: Canon Kabushiki Kaisha, Tokyo, Japan

[21] Appl. No.: 251,780

[22] Filed: Oct. 3, 1988

[30] Foreign Application Priority Data

Oct. 5, 1987 [JP] Japan ..... 62-252046

[51] Int. Cl.[5] ..... G03G 13/01; G03G 13/09

[52] U.S. Cl. ..... 430/45; 430/100; 430/111; 430/122

[58] Field of Search ..... 430/45, 100, 111, 122

[56] References Cited

U.S. PATENT DOCUMENTS

| | | | |
|---|---|---|---|
| 3,816,840 | 6/1974 | Kotz | 430/122 |
| 4,430,402 | 2/1984 | Tsushima | 430/45 |
| 4,435,494 | 3/1984 | Goto et al. | 430/122 |
| 4,554,234 | 11/1985 | Imai et al. | 430/122 |
| 4,583,490 | 4/1986 | Kan et al. | 118/658 |
| 4,606,990 | 8/1986 | Yoshikawa | 430/122 |
| 4,629,669 | 12/1986 | Shoji et al. | 430/122 X |
| 4,638,760 | 1/1987 | Nakamura et al. | 118/658 |
| 4,653,427 | 3/1987 | Hosaka et al. | 118/658 |
| 4,675,267 | 6/1987 | Haneda et al. | 430/122 X |

FOREIGN PATENT DOCUMENTS

| | | | |
|---|---|---|---|
| 59-88750 | 5/1984 | Japan | 430/122 |

*Primary Examiner*—Roland E. Martin

*Attorney, Agent, or Firm*—Fitzpatrick, Cella, Harper & Scinto

[57] ABSTRACT

A method of reverse development for depositing the toner particles to the light potential area of a photosensitive member. The developer used contains magnetic carrier particles and toner particles. An alternating electric field is formed in the developing position or zone. A relative volumetric ratio Q (%) of the magnetic carrier particles in the developing position satisfies $15.0 \leqq Q \leqq 28.0$. The relative volumetric ratio is defined as $$Q=(M/h)\times(1/\rho)\times C\sigma/(T+C)$$

where M ($g/cm^2$) is an amount of applied developer on a developing sleeve surface per unit area, h (cm) is a height of space in the developing position, $\rho$ ($g/cm^3$) is a true density of the magnetic carrier particles, C/(T+C) (%) is a weight ratio of the carrier particles in the developer on the surface of the sleeve, and $\sigma$ is a ratio of a peripheral speed of the sleeve relative to the peripheral speed of the photosensitive member.

28 Claims, 6 Drawing Sheets

DEVELOPING METHOD AND DEVICE AND COLOR IMAGE FORMING METHOD AND APPARATUS USING SAME

FIELD OF THE INVENTION AND RELATED ART

The present invention relates to a method and a device for developing an electrostatic latent image with a developer containing magnetic carrier particles and toner particles, and further to a color image forming method and apparatus using the developing method and device.

Japanese Laid-Open Patent Application Publication No. 32060/1980 discloses a developing method wherein two component developer containing the magnetic carrier particles and the toner particles is used and wherein an alternating voltage is applied to increase a density of the image to provide a high quality of the image. Subsequent to this method proposed, a number of proposals have been made for a developing system using the two component developer and using an alternating electric field.

European Patent Application 0,219,233A (U.S. Ser. No. 163,149) discloses an improved developing method of the alternating field application type. In this method, the toner deposited on the chains of the magnetic carrier particles and the toner deposited on the surface of the developer carrying member are both transferred to the image bearing member under the existence of the alternating electric field to provide a developed image.

However, neither publications specifically deal with to a reverse development, that is, the development wherein the toner is deposited onto the light portion potential area of the image bearing member.

In the system of the reverse development, the toner is electrically charged to a polarity which is the same as the dark portion potential of the image bearing member by friction with the carrier particles. On the other hand, the carrier particles are charged to a polarity opposite to that of the dark portion of the image bearing member. Since the carrier particles have a relatively high volume resistivity such as not less than $10^7$ ohm.cm, they retain the electric charge for a relatively long period. Under the alternating electric field application, such carrier particles periodically receive electric field forces toward the image bearing member. Since the carrier particles are charged to a polarity opposite to that of the dark part potential, they are easily electrostatically deposited onto the dark potential region of the image bearing member (non-image portion in the reverse development) by the periodical forces.

If a relatively large amount of the carrier particles are carried over by the dark potential region, the image bearing member tends to be damaged at the cleaning station Also, in an image transfer station, the carrier particles transferred onto a transfer material can damage an image fixing apparatus.

Usually, the polarity of the light potential portion is the same as that of the dark potential portion, and therefore, the carrier particles are easily deposited on the light potential region which is an image portion in the reverse development. If the carrier particles are deposited onto the light potential region, they disturb the toner image in this region.

Where a color image is formed by superposing plural developed images, the relatively large amount of carrier particles deposited on the image bearing member deteriorate each of the mono-chromatic images, and therefore, the deteriorations are integrated to significantly degrade the resultant color image.

In the reversal development, the charge polarity of the toner is the same as the polarity of the image-portion potential to which the toner is to be deposited, and therefore, the toner is not easily deposited on the image portion In order to enhance the deposition to the image portion, it is desired that the amount of charge of the toner is increased to increase the electrostatic mirror force to the image bearing member.

However, the amount of charge of the toner triboelectrically applied by the friction with the carrier particles, significantly varies depending on humidity. Therefore, the variation in the humidity leads to variation in the image density of the developed image.

As described, particularly when a color image is formed, the density variations of the respective monochromatic images are integrated to significantly degrade the resultant color image.

SUMMARY OF THE INVENTION

Accordingly, it is a principal object of the present invention to provide a reversal developing method and device wherein an amount of the carrier particles deposited onto the image bearing member is decreased.

It is another object of the present invention to provide a reverse development method and device wherein the variation in the image density depending on the variation in the humidity is decreased.

It is a further object of the present invention to provide a color image forming method and apparatus wherein plural different color images are superposed to provide a color image using a reverse development to provide a high quality color image.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
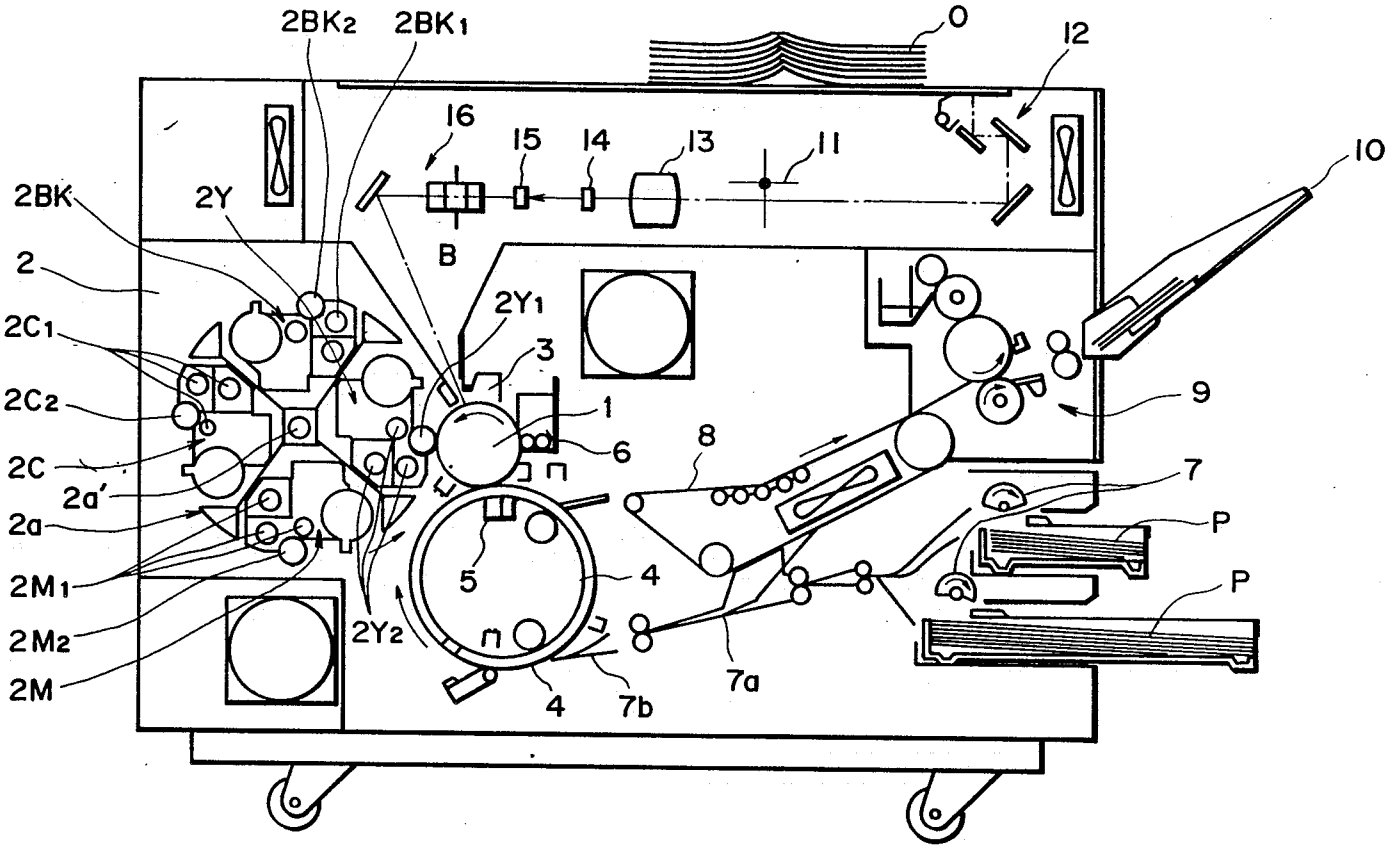
FIG. 1 is a color image forming apparatus to which the present invention is applicable.

Referring to FIG. 1, there is shown a color image forming apparatus according to an embodiment of the present invention, which comprises a multi-color developing device 2 having structures as disclosed Japanese Laid-Open Patent Application No. 93437/1975, for example, the structure including a rotatable member 2*a* rotatable about an axis 2*a'*, a yellow developing device 2Y, a magenta developing device 2M, a cyan developing device 2C and a black developing device 2BK, the developing devices being mounted on the rotatable member 2*a*. The developing devices use two component developers, which contains magnetic carrier particles and yellow toner particles, magenta toner particles, cyan toner particles and black toner particles, respectively, and which is of a contact type magnetic brush development. The developing devices include developer stirring screws 2Y1, 2M1, 2C1 and 2BK1, respectively, and magnet rollers 2Y2, 2M2, 2C2 and 2BK2. Each of the rollers includes a developing sleeve of non-magnetic material and a fixed magnet therein, which will be described hereinafter. The image forming apparatus comprises a latent image bearing member 1 rotatable in the direction indicated by an arrow and is in the form of an insulating drum for electrostatic recording or a photosensitive drum (or cylinder) or belt having a photoconductive material layer such as A-Se, CdS, ZnO, OPC (organic photoconductor) and A-Si. To the latent image bearing member 1, the yellow developing device 2Y is opposed at a developing station in the state shown in figure. The apparatus further comprises a charger 3, an image transfer drum 4 made of a film or mesh screen of a dielectric material, a transfer charger 5, a cleaning device 6, paper feeding guides 7*a* and 7*b*, a sheet feeding roller 7 for feeding a transfer sheet P, a conveyer belt 8 for conveying the transfer sheet from the image transfer drum 4 to an image fixing device 9.

An original 0 to be copied is scanned by a scanning optical system 12, and an image thereof is projected onto a photoelectric transducer type image sensor 14 such as the one having CCD elements, through a lens 13. The sensor 14 produces an image information signal, in response to which a semiconductor laser 15 is driven, and the beam B bearing the image information is produced by the laser 15. The beam B scans the surface of the drum 1 which has been charged by the charger 3, by way of a scanning optical system including a rotational polygonal mirror or the like. The light beam B is applied on an imaging portion of the image bearing member, that is, the portion to which the toner is to be deposited.

The apparatus further includes a separation optical system including blue, green, red and ND filters, which are selectively introduced into an image forming optical path.

When, for example, blue component light from the original is projected onto the sensor 14 through the blue filter, the laser beam B corresponding to the blue information of the original scans the drum 1, and a corresponding latent image is formed, and is visualized by the yellow developing device 2Y which has been placed by revolution to the developing station at a proper timing The visualized image is transferred onto a transfer sheet which is carried on the transfer drum 4, by the transfer charger The above described process from the image exposure to the image development, is repeated, after the photosensitive drum 1 is cleaned for the green light information through the green filter with the magenta developing device 2M, for red light information through the red filter with the cyan developing device 2C, and for the image information through the ND filter with the black developing device After each of the developing operations, the developed image is transferred onto the transfer sheet P carried on the transfer drum 4. Thus, the respective color toner images are superposedly transferred onto the transfer sheet P carried on the transfer drum 4. After completion of the series of the developing and transfer operations, the transfer sheet P is separated from the transfer drum 4, and is conveyed by the conveying belt 8 to the fixing device 9, where the visualized images are fixed, and the color image forming process is completed. The transfer sheet P now having the fixed color image is discharged to the tray 10.

The respective color developing devices are selectively moved by rotating the rotor 2A to a developing position where the non-magnetic sleeve which will be described hereinafter is opposed to the drum 1.

Figure 2:
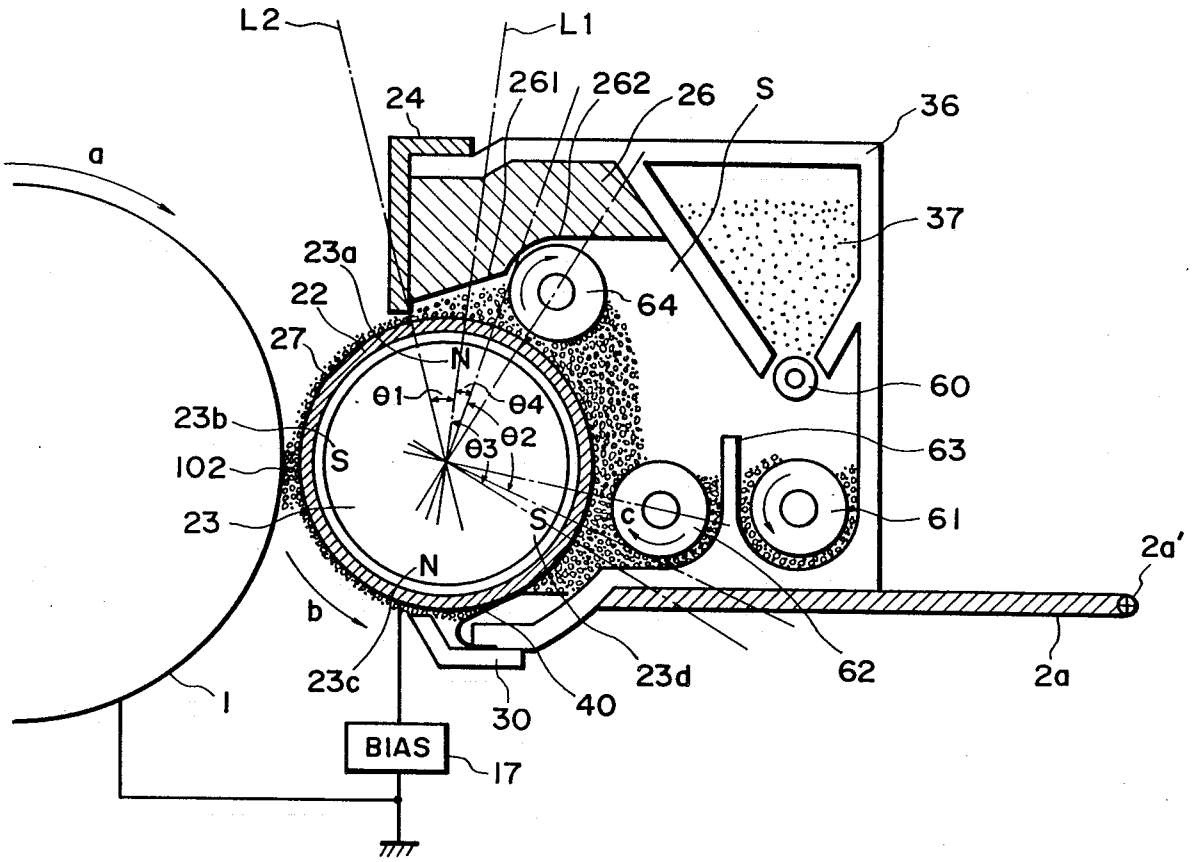
FIG. 2 is a sectional view of a developing device according to an embodiment of the present invention.

FIG. 2 is an enlarged sectional view of the developing position in a black developing device shown in FIG. 1. The other developing devices have the similar structure. The latent image bearing member 1 is driven in the direction indicated by an arrow a by an unshown driving device. The developing device includes a developing sleeve 22 which is opposed or contacted to the image bearing member 1 and is made of non-magnetic material such as aluminum, SUS 316 (stainless steel, JIS). The developing sleeve 22 is in a longitudinal opening formed in a lower left wall of a developer container 36, and about a right half peripheral surface is in the container 36, whereas about a left half peripheral surface thereof is exposed outside. The developing sleeve is rotatably supported and is driven in the direction indicated by an arrow b.

The developing device further includes a stationary magnetic field generating means in the form of a stationary permanent magnet within the developing sleeve 22. The permanent magnet 23 is fixed and is maintained stationary even when the developing sleeve 22 is rotated The magnet 23 has an N-pole 23*a*, S-pole 23*b*, N-pole 23*c* and an S-pole 23*d*, that is, it has four poles. The magnetic pole 23*b* is a developing magnetic pole for forming a magnetic field in the developing position where the developing sleeve 22 is opposed to the photosensitive member 1 with a small clearance and where the toner is supplied from the developing sleeve 22 to the latent image on the photosensitive member 1. The magnet 23 may be an electromagnetic in place of the permanent magnet. A non-magnetic blade 24 has a base portion fixed to a side wall of the container adjacent a top edge of the opening in which the developing sleeve 2 is disposed, and a free end extending at a top edge of the opening. The blade 24 serves to regulate the developer carried on the developing sleeve 22. The non-magnetic blade is made by, for example, bending to "L" shape a stainless steel plate (SUS316). The free end of the blade 24 is opposed to the developing sleeve 2 with a small clearance therefrom to regulate a thickness of the developer layer carried on the sleeve 22 to the developing position.

The developing device includes a magnetic carrier particle limiting member 26 which is disposed opposed to or in contact to the blade 24 at a position upstream of the blade 24 with respect to rotational direction of the sleeve 2. The bottom surface 261 of the limiting member 26 constitutes a developer guiding surface providing such a clearance with the sleeve 2 which decreases toward downstream with respect to the rotational direction of the sleeve 2 another surface 262 covers a screw 64 to guide the developer conveyed by the screw 64. The non-magnetic blade 24, the magnetic particle limiting member 26 define a developer regulating station.

The reference numeral 27 designates magnetic carrier particles having an average particle size of 30–100 microns, preferably 40–80 microns and having a resistivity of not less than $10^7$ ohm.cm, preferably not less than $10^8$, and not more than $10^{12}$ ohm.cm, preferably not more than $10^{10}$ ohm.cm. As an example of such carrier particles, ferrite particles (maximum magnetization 60 emu/g) are coated with very thin resin.

The resistivity of the magnetic particles is measured with a sandwiching type cell having a measuring electrode area of 4 $cm^2$ and having a clearance of 0.4 cm between the electrodes. One of the electrodes is imparted with 1 kg weight, and a voltage E(V/cm) is applied across the electrodes, and the resistivity of the magnetic particles is determined from the current through the circuit.

The reference numeral 37 designates non-magnetic developing toner.

A sealing member 40 is effective to prevent the toner stagnating adjacent the bottom of the developer container 36 from leaking The sealing member 40 is bent co-directionally with the rotation of the sleeve 22, and is resiliently pressed onto the surface of the sleeve 22. The sealing member 40 has its end portion at a downstream side in the region where it is contacted to the sleeve 22 so as to allow the developer returning into the container.

An electrode plate 30 for preventing scattering of the floating toner particles produced by the developing process, is supplied with a voltage having a polarity which is the same as the polarity of the toner to cause the toner particles to be deposited on the photosensitive member.

A toner supplying roller 60 is operative in response to an output of an unshown toner content detecting sensor. The sensor may be, for example, of a developer volume detecting type, a piezoelectric element type, an inductance change detecting type, an antenna type or an optical density detecting type. By the rotation of the roller 60, the non-magnetic toner 37 is supplied The supplied toner 37 is mixed and stirred while being conveyed by the screw 61 in the longitudinal direction of the sleeve 22. During the conveyance, the toner supplied is triboelectrically charged by the friction with the carrier particles. A partition 63 is cut-away at the opposite longitudinal ends of the developing device to transfer the supplied developer conveyed by the screw 61 to another screw 61. The developer conveying direction by the screw 62 is opposite to that of the screw 61.

The S-pole 23*d* is a conveying pole for collecting the developer remaining after the developing operation back into the container, and to convey the developer in the container to the regulating portion, by the magnetic field provided thereby.

Adjacent the magnetic pole 23*d*, the fresh developer conveyed by the screw 62 adjacent the sleeve 22 replaces the developer on the sleeve 22 corrected after the development.

A conveying screw 64 is effective to make uniform the distribution of the developer amount along the length of the developing sleeve. The developer conveyed on the sleeve together with the rotation of the sleeve is conveyed along the length of the sleeve by the screw 64. The developer layer portion which is partly thick along the longitudinal direction of the sleeve is partly returned in the direction opposite to the sleeve movement through the space S in FIG. 2. The screw 24 conveys the developer in the direction opposite to that of the screw 62.

This structure is effective also when magnetic particles and non-magnetic or weakly magnetic toner particles are mixed in the developer container.

The distance $d_2$ between the edge of the non-magnetic blade 24 and the surface of the developing sleeve 22 is 50–900 microns, preferably 150–800 microns. If the distance is smaller than 50 microns, the magnetic carrier particles may clog the clearance to easily produce non-uniform developer layer, and to prevent application of sufficient amount of the developer with the result of low density and non-uniform density image. Further, the clearance $d_2$ is preferably not less than 400 microns since then it can be avoided that a non-uniform developer layer (clogging at the blade) is produced by foreign matter contained in the developer (such as coagulated developer and waste thread). However, if such foreign matter is hardly contained, this condition is not inevitable. If, on the other hand, the distance is larger than 900 microns, the amount of the developer applied on the developing sleeve 22 is increased too much, and therefore, proper regulation of the thickness of the developer layer can not be performed, and the amount of the magnetic particles deposited on the latent image bearing member is increased, and simultaneously, the circulation of the developer which will be described hereinafter and the regulation of the circulation by the developer limiting member 26 are weakened with the result of insufficient triboelectric charge leading to production of foggy background.

In FIG. 2, a line L1 is a line connecting a rotational center of the sleeve 22 and the center of the developer layer thickness regulating pole 23*a*, that is, the maximum magnetic flux density position on the sleeve surface; a line L2 is a line connecting the rotational center of the sleeve 22 and the free edge of the blade 24; and an angle $\theta 1$ is an angle formed between the lines L1 and L2. The angle $\theta 1$ is within the range of −5–35 degrees, preferably 0–25 degrees. If the $\theta 1$ is smaller than −5 degrees, the developer layer formed by the magnetic force, mirror force and coagulating force applied to the developer becomes non-uniform, whereas if it is larger than 35 degrees, the amount of application of the developer on the sleeve by a non-magnetic blade is increased with the result of difficulty in providing a predetermined amount of developer. The negative of the angle $\theta 1$ means that the line L1 is disposed downstream of the line L2 with respect to the rotational direction of the sleeve 22.

Between the magnetic pole 23*d* position and 23*a* position in the container 36, the speed of the developer layer on the sleeve 22 becomes lower away from the sleeve surface due to the balance between the conveying force by the sleeve 22 and the gravity and the magnetic force against it, even though the sleeve 22 is rotated in the direction indicated by an arrow b. Some part of the developer falls by the gravity.

Therefore, by properly selecting the positions of the magnetic poles 23a and 23d, fluidability of the magnetic particles 27 and the magnetic properties thereof, the developer layer is moved more in the position closer to the sleeve 22, to constitute a moving layer. By the movement of the developer, the developer is conveyed to a developing position together with the rotation of the sleeve 2, and is provided for the developing operation.

Figure 3:
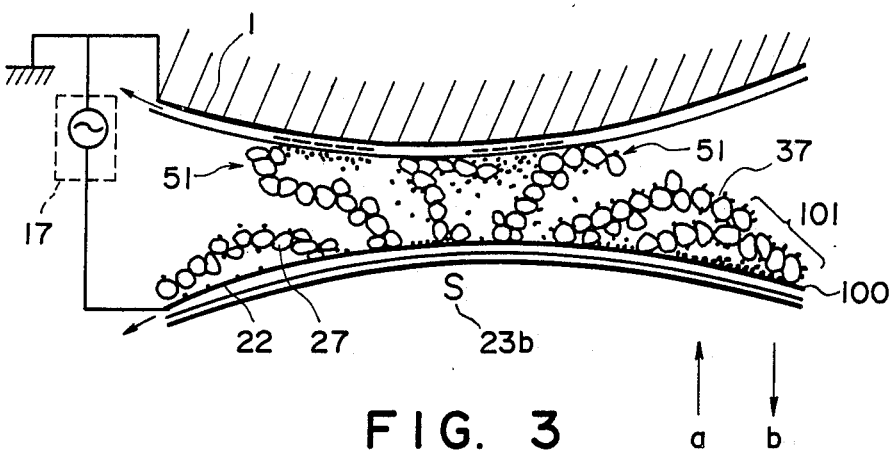
FIG. 3 is an enlarged sectional view at a developing position of a developing device according to the embodiment of the present invention.

FIG. 3 is an enlarged sectional view of the developing position illustrating the developing action. The photosensitive drum 1 retains the electric charge constituting the latent image. In this embodiment, the electric charge constituting the latent image is negative, and the reversal development is performed, and therefore, the toner particles are charged negative. In FIG. 2, the photosensitive drum 1 and the sleeve 22 rotate such that the peripheral movements thereof are co-directional, as indicated by the arrows. Across the clearance formed therebetween, the above described alternating voltage is applied from the power source 34. At a position corresponding to a position where the photosensitive drum 1 and the sleeve 22 closest, the magnetic pole 23b of the magnet 23 is disposed within the sleeve 22.

In the space between the photosensitive drum 1 and the sleeve 22, there is the developer which is the mixture of the magnetic particles 27 and the toner particles carried on the rotating sleeve 22.

Because of a relative volumetric ratio, which will be described hereinafter, of the magnetic particles in the developing position, the amount of the magnetic particles present in this position is far less than in usual so-called magnetic brush developing system, and in this point, the developing system according to this embodiment is essentially different from these usual magnetic brush development systems. The very small amount of the magnetic particles 27 form relatively sparse chains 51 of the magnetic particles by the magnetic pole 23a.

Due to the larger movability of the magnetic particles 23 provided by a sparseness, the action of the magnetic particles 27 is peculiar.

More particularly, the sparse chains of the magnetic particles are distributed uniformly in the direction of the magnetic lines of force, and simultaneously, the surface of the sleeve 21 as well as the surface of the magnetic particles are opened. Therefore, the toner particles on the magnetic particle surfaces can be supplied to the photosensitive drum without obstruction by the chains, and simultaneously, the uniformly distributed opened portions of the sleeve surface can be established, whereby the toner particles can be transferred from the sleeve surface to the photosensitive surface by the alternating electric field. The description will be made as to the behavior of the magnetic particles and the toner particles. As shown in FIG. 3, the latent image is formed by negative potentials both at the image (light) portion and non-image (dark) portion, wherein the absolute value of the non-image area potential is larger than that of the image area potential. The toner is also electrically charged to a negative polarity. The direction of the electric field provided by the alternating electric field alternates as shown by arrows a and b. In the phase wherein the negative voltage is applied to the sleeve 22, the direction of the electric field thereby is as indicated by the arrow b. At this time, the amount of the electric charge injected into the chains 51 is maximum, and therefore, the chains 51 stand up most, and long chains reach to the surface of the photosensitive drum 1.

On the other hand, the toner particles 28 on the sleeve surface and the magnetic particle surfaces are charged in the negative polarity as described hereinbefore, they are transferred to the photosensitive drum 1 by the electric field formed in this space. It should be noted here that the erected chains 51 are sparsely distributed, so that the surface of the sleeve 22 is exposed or uncovered, whereby the toner particles are released both from the surface of the sleeve 22 and the surface of the chains 51.

During the phase wherein the positive voltage is applied to the sleeve 22, the electric field by the alternating voltage (arrow a) and the electric field (arrow b) are counter-directional. Therefore, the electric field in this phase is strong in the opposite direction, so that the amount of charge injection is relatively small. Consequently, the chains 51 are collapsed in accordance with the amount of the charge, and they are contacted to the photosensitive member in this collapsed state.

Since the toner particles 28 on the photosensitive drum 1 are charged negative as described hereinbefore, the toner particles transfer back to the sleeve 22 and back to the magnetic particles 27 from the photosensitive drum 1 by the electric field formed across the space. In this manner, the toner particles 37 reciprocate between the photosensitive drum 1 and the surface of the chains 51. With the increase of the clearance therebetween caused by the rotation of the photosensitive drum and the sleeve 22, the electric field is weakened, and the developing operation terminates.

Now, the description will be made with respect to the relative volumetric ratio which defines the amount of the magnetic carrier particles conveyed into the developing position in the developing device having the structure described above. The relative volumetric ratio is defined in the developing position or zone where the toner particles are transferred or supplied from the sleeve 22 to the photosensitive drum 1.

The relative volumetric ratio is defined by an amount M ($g/cm^2$) of the developer (mixture of the magnetic carrier particles and toner particles) per a unit area of the surface of the sleeve 22, a height h (cm) of the developing zone space (the distance between the sleeve surface and the drum surface), a true density $\rho$ ($g/cm^3$) of the carrier particles, weight content of the carrier particles on the surface of the sleeve C/(T+C) (%) (C is weight of the carrier particles, and T is a weight of the toner particles), and a relative speed ratio $\sigma$ between the sleeve 22 and the photosensitive member 1. More particularly, the relative volumetric ratio Q is defined as $$Q=(M/h)\times(1/\rho)\times[C/(T+C)]\times\sigma$$

The amount of application M is measured after the developer layer is formed on the sleeve with the regulation by the developer layer regulating station and at such a position that the magnetic brush of the developer is not erected on the surface of the sleeve.

The relative volumetric ratio Q is influenced by the structure of the developing device described hereinbefore, more particularly, by the positions of the magnetic poles of the magnet roller 23, the strengths of the magnetic poles, configuration of the developer limiting member 26, the distance $d_2$ between the edge of the non-magnetic blade 24 and the surface of the sleeve 22 or the like.

It has been found that the relative volumetric ratio of the magnetic particles in the developing position is very much influential to the copy image, particularly, the density thereof; particularly in the reverse development wherein the toner is deposited onto the area of the photosensitive member exposed to light, that is, the light potential area, the relative volumetric ratio is greatly influential to the amount of carrier particles to the dark potential area (non-image area). The variation in the image density and the increase of the carrier deposition onto the non-image area, are not preferable in monochromatic image formations, but they are more significant in color image formations wherein monochromatic images by different colors are superposed, since the defects of the monochromatic images are integrated with the result of remarkable deterioration of the total image quality.

The inventors have conducted various experiments and tests under various conditions, noting the relations between the volumetric ratio Q and the image density, and between the volumetric ratio Q and the amount of carrier deposition to the photosensitive member, and the results of same tendency have been obtained. On the basis of the results, it has been found that good images, more particularly, good color copy images can be provided if the relative volumetric ratio Q is $15.0 \leqq Q \leqq 28.0$.

Figure 4:
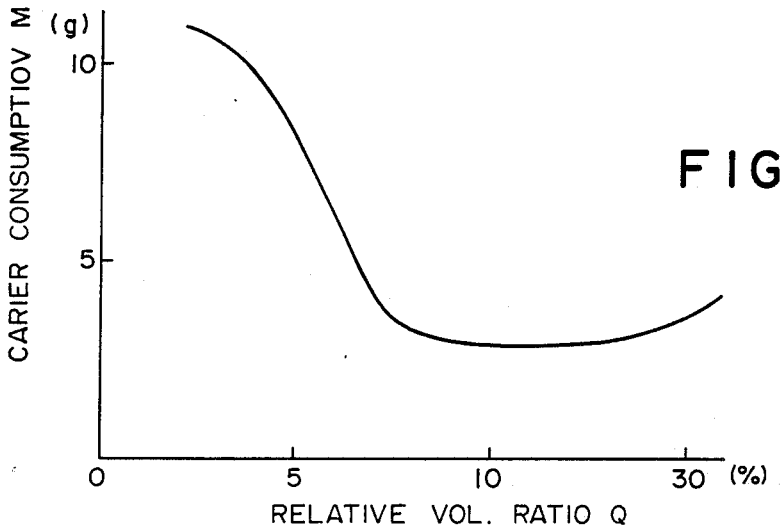
FIG. 4 is a graph of carrier consumption vs. relative volumetric ratio.
Figure 5:
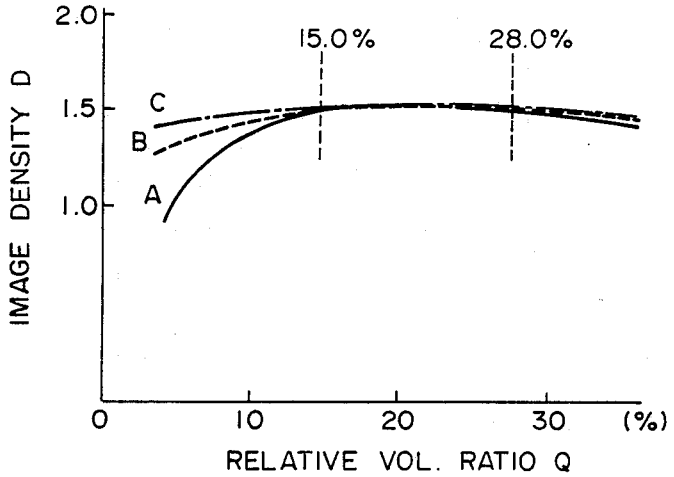
FIG. 5 is a graph showing a change in the image density.

FIGS. 4 and 5 show an example of the experiments. The developing device and the developing conditions described in conjunction with FIG. 2 were used. More particularly, each of the screws was made by helically winding aluminum strip on a core metal of aluminum having an outer diameter of 6 mm to provide an overall diameter of 12 mm. The pitch of the screw (between the adjacent portion of the strip) was 10 mm in the screw 61, 20 mm in the screw 62 and 5 mm in the screw 64. The rotational directions were determined such that the developer was conveyed toward the front side of the sheet of the drawing of FIG. 2 by the screw 61, toward the backside by the screw 62 and toward the front side by the screw 64.

The number of revolutions of the screw 61 was 250 rpm; the screw 62, 320 rpm; and the screw 64, 170 rpm.

The peripheral speed of the sleeve was 210 mm/sec, and the peripheral speed of the photosensitive drum was 160 mm/sec.

In the figure, as for the sleeve 22, a surface of a sleeve of stainless steel (SUS316) having a diameter of 20 mm was sand-blasted with ALUNDUM abrasive having irregular configurations of No. 400. The magnet 23 had four magnetic poles, wherein N poles and S poles were alternately arranged. The clearance between the sleeve 22 and the edge of the blade 24 was 350 microns. The blade 24 was made of non-magnetic stainless steel having a thickness of 1.2 mm. The magnetic particles were ferrite particles (maximum magnetization of 60 emu/g) coated with very thin silicone resin and having an average particle size of 60–50 microns and a true density of 5.16 g/cm$^2\mu$.

As for the non-magnetic and electrically insulative toner particles contained 100 parts of polyester resin and about 5 parts of a pigment and had an average particle size of 11 microns. The pigment was copper phthalocyanine pigment for the blue toner; diazo pigment for the yellow toner; monoazo pigment for the magenta toner. As for the black toner, the above pigments were mixed at a ratio of approximately 1:2:1. For each toner, 0.4% of colloidal silica was added.

The thickness of the developer layer formed on the sleeve was 300–500 microns, and C/(C+T) was approximately 8–12%.

The magnetic particles were erected at and adjacent the developing position by the magnetic field provided by the magnetic pole **23*b* in the sleeve 22**, and the maximum length of the chain was approximately 0.8–1.3 mm, constituting a magnetic particle layer of a magnetic brush to which the toner particles were deposited. When the developing operation was started, 270 g of the magnetic particles and 30 g of the toner particles were mixed.

The developing device was incorporated in the color image forming apparatus shown in FIG. 1. The photosensitive drum 1 was made of an organic photoconductor and was spaced from the surface of the sleeve 22 by the clearance of 450 microns.

The ratio of the photosensitive drum peripheral speed and that of the developing sleeve was 1:1.3, that is, $\sigma = 1.3$. The amount of the applied developer M was 40 mg/cm$^2$ when the developer was not erected on the sleeve 22. The outer diameter of the photosensitive drum was 60 mm. The photosensitive drum was made of an organic photoconductor (OPC), and the dark area potential (non-image area potential) $V_D$ was $-600$ V; and the light area potential (image area potential) VL was $-250$ V. The bias source 17 supplied to the sleeve 22 was a combined voltage of a DC voltage of $-490$ V and an alternating voltage in the form of a pulse wave having a frequency f of 1700 Hz and a peak-to-peak voltage Vpp 1500 V.

FIG. 4 shows the consumption of the carrier particles when 50,000 sheets having A4 size were copied. The consumption of the carrier particles means the amount of the carrier particles removed from the developing device by being deposited onto the photosensitive member. As will be understood from FIG. 4, the carrier consumption steeply increases when the relative volumetric ratio Q of the magnetic carrier particles in the developing position decreases beyond 14%. It has been observed that when the relative volumetric ratio Q decreases beyond 14%, a quite large amount of the carrier particles are deposited onto the dark potential area (non-image area), and therefore, is removed from the developing position; and that in the light potential area (image portion), such an amount of carrier particles which are not negligible are deposited. However, it has been found that when the relative volumetric ratio is not less than 14%, the carrier consumption decreases, and that the variation thereof is small. It is an unexpected result that in the range less than 14% of the relative volumetric ratio Q, that is, in the region where the amount of the magnetic carrier particles in the developing position is relatively small, the carrier particle consumption is large, and that the carrier particle consumption decreases in the range not less than 14% of the relative volumetric ratio. The reason for this is not very clear, but it is predicted that the magnetic carrier particles present with the relative volumetric ratio of not less than 14% behave under the existence of the alternating electric field so as to control the carrier consumption.

A change of the image density with the change of the ambient conditions were investigated, and the results thereof are shown in FIG. 5.

In FIG. 5, "A" represent the temperature of 20°C. and the relative humidity of 10%; "B" the temperature of 23°C. and the relative humidity of 60%; and "C" the temperature of 30°C. and the relative humidity of 80%.

As will be understood from the curves of this figure, when the relative volumetric ratio is beyond approximately 8%, the image density is not less than 1.3, so that a satisfactory solid black image can be provided. When the volumetric ratio is not less than approximately 10%, the change in the image density relative to the change of the volumetric ratio, and therefore, the image density is saturated.

From the relationships shown in this figure, it is understood that if the relative volumetric ratio Q satisfies $15.0 \leqq Q \leqq 28.0$, the good image property can be always maintained, that is, the image density change is very small, even under the varied conditions of ambience.

If it is smaller than 15%, the image density varies greatly with even a small change of the relative volumetric ratio Q, particularly under the low humidity condition. In addition, the thickness of the developer layer formed on the surface of the sleeve 22 becomes non-uniform as a whole, and particularly in the half tone area, the non-uniform image results. If the relative volumetric ratio Q exceeds 28.0%, the degree of coverage of the sleeve surface by the magnetic brush of the carrier particles increases, resulting in foggy background and the decrease in the image density attributable to the obstruction to the developer movement between the sleeve 22 and the photosensitive member 1 under the alternating electric field.

It is, therefore, understood that the $15.0 \leqq = Q \leqq 28.0$ is preferable since then the carrier consumption is confined, and the image density is stabilized.

The image density and the image quality do not change monotonously in accordance with increase or decrease of the amount of the developer applied on the sleeve 22 and the space in the developing position. Noting this peculiar phenomenon, it has been found that the satisfactory and stabilized image density by the reverse development and the sufficient reduction of the carrier consumption (deposition to the photosensitive member) can be obtained when the relative volumetric ratio Q which is the amount of the magnetic particles in the developing zone in consideration of the time is not less than 15% and not more than 28%. In the reverse development, the polarity of the charged toner is the same as that of the light potential area of the photosensitive member, and therefore, the same as the polarity of the dark potential area, and therefore, the force of deposition of the toner to the light potential area (image portion) is small. Therefore, the toner on the image area is liable to scatter, with the result of deteriorated image quality. In the above-described range of $15.0 \leqq Q \leqq 28.0$, the scattering is decreased. The reason for this is not very clear, but it is predicted that the amount of the carrier particles is appropriate to mechanically urge the toner to the light potential area, thus enhancing the deposition force.

In the toner powder, there is a small amount of toner particles effective to charge the dark portion to the opposite polarity (reverse toner). By the reversed toner, the foggy background results. In the range of $15.0 \leqq Q \leqq 28.0$, the production of the foggy background by the reverse toner is decreased. It is predicted that the existence of a proper amount of the carrier particles, makes it easier for the reversed toner deposited on the photosensitive member to separate therefrom.

When the relative volumetric ratio is in the range of 15.0–28.0%, the chains of the carrier particles are formed on the sleeve surface and are distributed sparsely to a satisfactory extent, so that the toner particles on the chain surfaces and those on the sleeve surfaces are sufficiently opened toward the photosensitive drum 1, and the toner on the sleeve as well as the toner on the carrier chains are transferred to the photosensitive member under the existence of the alternating electric field. Thus, almost all of the toner particles are consumable for the purpose of development. Accordingly, the development efficiency (the ratio of the toner consumable for the development to the overall toner present in the developing position) and also a high image density can be provided. The fine but violent vibration of the carrier chains is produced by the alternating electric field, by which the toner powder deposited on the magnetic particles and the sleeve surface are sufficiently loosened. In any case, the trace of brushing or occurrence of the ghost image as in the magnetic brush development with a DC bias can be prevented. Additionally, the vibration of the chains enhances the frictional contact between the magnetic particles 27 and the toner particles 28, with the result of the increased triboelectric charging to the toner particles 28, by which the occurrence of the foggy background can be prevented.

The desirable range of the relative volumetric ratio Q is as described above. It is further preferable that the ratio of the sleeve peripheral speed to that of the photosensitive member, that is the relative speed ratio $\sigma$ is $1.0 < \sigma \leqq 1.75$. By providing a relative speed between the sleeve 22 and the photosensitive member 1, the mechanical brushing can be produced, and is used to collect the unnecessary fog toner or carrier deposited on the photosensitive member back into the developing device. In addition, by the relative speed ratio not less than 1, the development efficiency is increased. However, if the relative volumetric ratio of the magnetic carrier particles in the developing position under the condition of $\sigma > 1.75$, the collecting effect is too strong, resulting in production of the trace of brushing or image density decrease of the resultant image. By making the relative speed ratio $\sigma$ not more than 1.75, the toner is prevented from scattering outside the developing device during the developing operation. If the relative speed ratio $\sigma > 1.75$, the image density in the solid image is not uniform, in such a form as when powder is swept together.

Figure 6:
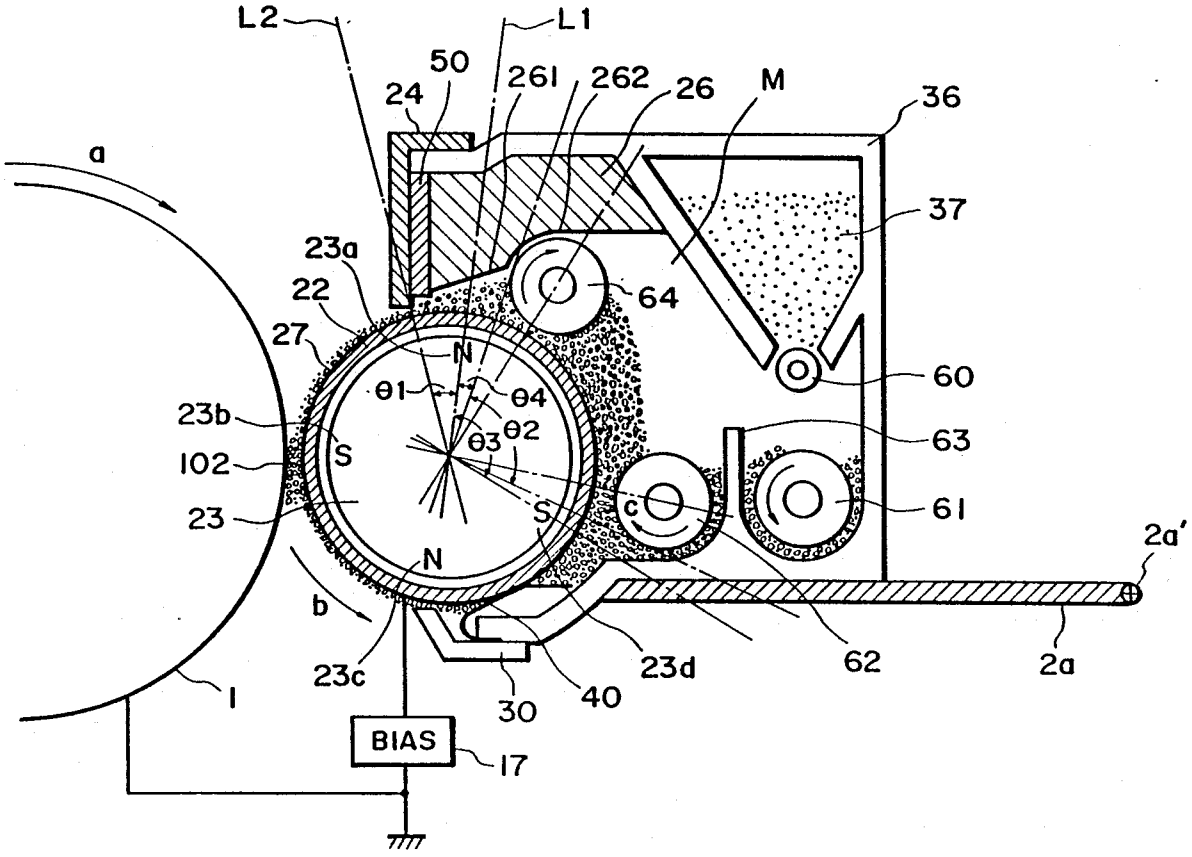
FIG. 6 is a sectional view of a developing device according to another embodiment of the present invention.

FIG. 6 shows a developing device according to another embodiment of the present invention. The device of this figure is similar to the developing device shown in FIG. 2 in the structure and the developing conditions, but a plate 50 of ferromagnetic material such as iron or nickel is mounted to the non-magnetic blade side of the developer limiting member 26, wherein the clearance between the edge thereof and the sleeve 22 is larger than the clearance between the non-magnetic blade 24 and the sleeve 22. It is not preferable that the magnetic plate 50 is disposed right opposed to the center of the magnetic pole **23*a*, because then the magnetic field is very strongly concentrated between the magnetic plate 50 and the magnetic pole 23*a* with the result that the stirring and loosening effect to the magnetic particles by the magnetic pole 23*a* decreases. Therefore, the magnetic plate 50 is disposed at a position downstream of the center of the magnetic pole 23*a* with respect to the rotational direction of the sleeve. It is preferable to provide the magnetic plate 50 at the developer layer regulating station and to form a relatively strong concentrated magnetic field with the magnetic pole 23*a* in the sleeve to magnetically regulate the magnetic particles, since then the tolerance of the clearance between the regulating member 24 and the sleeve. In addition to the larger tolerance, the clearance itself between the regulating member 24 and the sleeve 22 can be enlarged, by, for example, not less than 100 microns as compared with the case of the first embodiment wherein the non-magnetic blade only is used. The angle θ1** can be increased by 3–7 degrees as compared with the case of the non-magnetic blade only.

In this embodiment, the distance between the magnetic plate 51 and the sleeve 22 surface is 950 microns, and the distance $d_2$ between the edge of the non-magnetic blade 24 and the developing sleeve surface 22 is 650 microns. With those dimensions, the clearance $d_2$ is not clogged, and therefore, the non-uniform application of the developer on the sleeve was assured to be prevented.

When the comparison is made between the toner particles deposited on the magnetic particles and on the sleeve, the amount of charge of the toner deposited on the sleeve is smaller than that on the magnetic particles. This is because the magnetic particles are conveyed together with the sleeve movement, and therefore, the opportunity of the toner particles on the sleeve being frictioned with the magnetic particles is smaller. In order to increase the charge of the toner on the sleeve to a desirable level, the toner on the sleeve is preferably frictioned positively. In view of this, existence of the magnetic particles providing a relative speed adjacent the surface of the sleeve against the movement of the sleeve is considered.

However, simply decreasing the conveyance of the magnetic particles is not practical if the consideration is paid to the conveyance of the developer collected back after the development as described hereinbefore. Increasing the friction of the magnetic particles on the sleeve by producing concentrated magnetic field by disposing a magnetic member in opposition to the inside pole 23a in the regulating station, as described hereinbefore, is not preferable since it deteriorate the advantage provided by disposing the maximum magnetic force producing portion by the magnetic pole 23a in the space defined by the developer circulation regulating member 26.

In consideration of those problems, the magnetic member 50 is disposed downstream of the magnetic pole 23a with respect to the rotational direction of the sleeve, so that the magnetic lines of force at the blade side provided by the magnetic pole 23a are concentrated in the tangential direction of the sleeve surface. By this, only the magnetic particles in the neighborhood of the sleeve surface form a magnetic brush along the surface of the sleeve so as to friction with the toner particles on the sleeve to increase the triboelectric charge of the toner on the sleeve.

From the standpoint of the conveyance of the developer between the magnetic poles 23d and 23a, the provision of the magnetic member 50 provides a larger latitude in the location of the magnetic poles 23a and 23d and the screw 62. By the provision of the magnetic member 50 in the regulating station, the conveyance force to the developer in the regulating station can be lowered. As a result, the lower conveyance property in the upstream conveyance path can be compensated by the regulating station. Therefore, the conveyance passage upstream of the regulating station can be reduced, which makes it possible to reduce the size of the developing sleeve. Therefore, the developing apparatus can be simplified and can be made smaller.

The developer on the sleeve in the developer container is magnetically strongly retained by the above structure, and therefore, is not easily separated from the sleeve even by an external vibration, even to such an extent that when the developing device is rotated about the shaft 2a', and then it is immediately re-operated at the developing position, the uniform developer application can be stably provided.

The magnetic flux density of the magnetic pole 23a is not less than 600 Gausses on the surface of the sleeve 22, preferably not less than 700 Gausses. This is because the state of developer application is stabilized more against change of the toner content in the magnetic particle layer with the increased magnetic flux density of the cutting magnetic pole 23a. Particularly when the developing device is not provided with an automatic toner supplying device to maintain a predetermined toner content, the magnetic flux density is preferably not less than 800 Gausses.

However, with the increase of the magnetic force of the magnetic pole 23a, the conveyance force to the developer is increased, so that the amount of application of the developer on the sleeve increases, and therefore it should be selected within the preferable range. According to the inventors' experiments 800–1200 Gausses are preferable in consideration of the other structures of the developing device.

In FIG. 6, the developing magnetic pole 23b is substantially in the developing zone, and it preferably provides a magnetic flux density of not less than 800 Gausses in order to prevent the deposition of the magnetic particles to the latent image.

In addition to the above-described advantages, the tolerance for the amount of the developer on the sleeve in the developing zone and the tolerance for the angle θ1 shown in FIG. 6 are increased. The increase of the tolerance for the angle θ1 together with the other mechanical tolerances in the developer regulating station, and the amount of the developer on the sleeve without use of the magnetic member 50 is further stabilized as compared with the embodiment shown in FIG. 2, and therefore, is not changed greatly. Accordingly, good images can be stably provided.

If the relative volumetric ratio Q is within the above described range, that is, $15.0 \leqq Q \leqq 28.0$, the development is preferable particularly for the color image formation.

Figure 7:
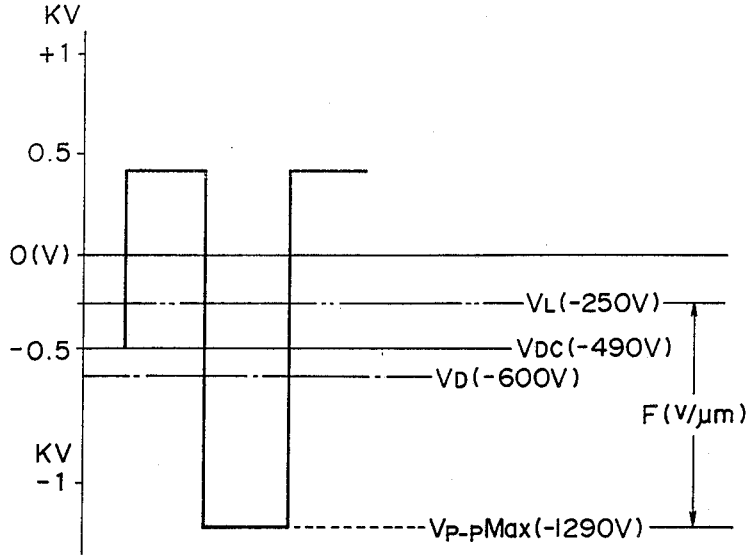
FIG. 7 is a graph showing an alternating electric field.

Referring to FIG. 7, there is shown an example of a waveform of the voltage applied to the sleeve 22 from the power source 17 for the purpose of forming the alternating electric field in the developing zone. In this example, the waveform is rectangular. In an ordinary developing process wherein the toner is deposited onto the dark potential area of negative polarity, the bias voltage is positive in order to provide the maximum electric field for transferring the toner to the dark potential area. However, since the present invention deals with the reverse development, the toner is deposited to the light potential $V_L$ area of the negative polarity with the dark potential $V_D$ area of the same negative polarity in the background, the maximum value VppMax providing the maximum electric field for transferring the toner to the light potential area $V_L$ is of negative polarity.

As described hereinbefore, the carrier particles can be deposited not only onto the non-image portion (background) and also to the image area. If the carrier particles are deposited to the image area, it has been found that the tone of the image is partly decreased by the carrier particles, and the image density is also decreased thereby. Therefore, the investigations have been made as to the developing system whereby the carrier deposition to the image area can be further decreased, in addition to the abovedescribed condition of $15.0 \leqq Q \leqq 28.0$.

The inventors have found a problem peculiar to a mixture developer. That is, by the maximum magnetic field tending to deposit a large amount of toner particles to the image area, some carrier particles are injected with electric charge from the sleeve, and the injected charge is attributable to the carrier deposition to the photosensitive member. On the basis of this finding, various experiments and considerations have been made including the maximum magnetic field strength being gradually decreased from such a high level as in the conventional devices, and finally the conditions under which the carrier particle deposition can be significantly decreased. The prevention of the carrier particle deposition was started for the purpose of enhancing the reproducibility of the tone of the image, but it was found that if the maximum electric field strength was too weak, the tone reproducibility was not good because of insufficient image density.

The maximum electric field strength F (V/micron) in the image area is expressed as $$F=(|VppMax-V_{DC}|+|V_{DC}+V_L|)/G$$

where $V_L$ (V) is a potential of the image area;

$V_{DC}$ (V) is a voltage of the DC component of the alternating voltage (sleeve surface potential);

VppMax (V) is the voltage at the maximum electric field application point which is at the opposite side of the image portion potential $V_L$;

G (micron) is the minimum clearance between the surface of the image bearing member (sleeve) and the surface of the electrostatic latent image bearing member (photosensitive member).

In FIG. 7, since the development is a reverse development, the background potential $V_D$ is $-600$ (V), and the electrostatic latent image potential $V_L$ is $-250$ (V), and for the purpose of prevention of the toner particles from depositing on the background area, the DC component $V_{DC}$ of the alternating developing bias voltage is $-490$ (V).

The voltage VppMax (V) is $-1290$ V. Such an alternating electric field is formed in the developing position or zone.

When the minimum clearance G was changed with the range of 350–500 microns. $F=[|-1290-(-490)|+|-490-(-250)|]/G$ was 2.97 (V/micron) at 350 microns; 2.60 (V/micron) at 400 microns; 2.31 (V/micron) at 450 microns; and 2.08 (V/micron) at 500 microns. In any case, the carrier deposition to the image area could hardly be observed, and the tone reproducibility was good. When the clearance was set to be 340 microns, the carrier particles were deposited on the image area in an uniform content, and the entire tone reproducibility was decreased. Also, the image was roughened, and is made non-uniform during image transfer after development.

At this time, the electric field strength was 3.06 (V/micron). When the clearance was 350 microns, the electric field strength was 2.97 (V/micron), and very small amount of the carrier particles are deposited, and therefore, the carrier deposition was sufficiently prevented, and also, the image was uniform enough. When the minimum clearance was 505 microns, the electric field strength was 2.06, and although the carrier deposition is decreased, the tone reproducibility was worse than when the carrier particles are deposited, and the sharpness of a line image decreases, with the decrease of the image density. Further, it is set to 500 microns, the tone reproducibility is recovered with sufficient image density.

The above-described example is only a part of the experiments. When the alternating bias voltage applied to the sleeve 22 is changed with the clearance G constant, it has been confirmed that the tone reproducibility is better, and the carrier deposition is hardly observed if the maximum electric field strength F is not less than 2.07 and not more than 3.0 in the image portion, as compared with the other development conditions. Accordingly, in order to significantly prevent carrier deposition and sufficient image density and image reproducibility, it is preferable that $2.07 \leqq F \leqq 3.00$ are satisfied. The maximum electric field strength F is further preferably not more than 2.8, since then a crape-like deterioration of the image which is partly observed when the maximum electric field strength F is larger than 2.8 (due to the deposition of the carrier particles to the image portion), is not observed. Therefore, $F \leqq 2.8$ is further preferable.

Additionally, the carrier particles having an intermediate resistance carrier particles having a lower resistance is preferable to insulative carrier particles, and preferably they have a resistivity of not less than $10^7$ ohm.cm and not more than $10^{12}$ ohm.cm, further preferably not less than $10^8$ ohm.cm and not more than $10^{10}$ ohm.cm. Further preferably, the carrier particles are coated with thin resin layer. The carrier particles can be deposited to the non-image area, but if the above-described conditions of $15.0 \leqq Q \leqq 28.0$ is satisfied, it is preferable from the standpoint of carrier deposition prevention to the non-image area. In order to further decrease the carrier particle deposition to the non-image area, it is preferable that $50 \leqq |V_{DC}-V_D| \leqq 200$ is satisfied even when the DC component $V_{DC}$ of the alternating voltage is variable in response to the non-image area potential $V_D$ (V). Since the non-image area potential may vary together with change in the ambient condition, and therefore, in order to assure the toner deposition, the absolute value of $V_{DC}-V_D$ is preferably not more than 150 (V). This is also preferable from the standpoint of further preventing the production of the foggy background by the reverse toner.

An additional preferable conditions are $1.8 \leqq \nu \leqq 2.2$, where $\nu$ is a frequency (KHz) of the alternating electric field. If it is satisfied, the fog prevention, the sharpness of the line image and the tone reproducibility is very good, although these are the absolute requirements.

As an example, image forming operation was actually performed with the non-image area potential on the photosensitive member being $-600$ V, the potential of the image area being $-250$ V, the frequency of the AC component of the developing bias applied on the developing sleeve being 2000 Hz±200 Hz and the peak-to-peak voltage being 1800 V±200 V. The DC voltage was $-490$ V. In addition to the advantageous effects described with the foregoing two embodiment, the image density did not decrease from that at the initial stage even after 50,000 sheets were processed. Also, the image quality was maintained. The magnetic particles were not deposited onto the photosensitive drum, and sharp and light color images were produced.

In those embodiments, the development is a so-called reverse development. This is used because it is better in the reproducibility of a line image in a system wherein the photosensitive member is exposed to a laser beam or the like. This is preferable when a high quality of image is required.

However, in the case of the reverse development, there is no electrostatic latent image charge having the polarity opposite to that of the toner, and therefore, the deposition between the photosensitive member and the toner is more or less provided by the mirror force. Therefore, the amount of charge of the toner is preferably large from the standpoint of prevention of scattering of lines and scattering of the toner. For example, in this embodiment, the amount of charge is $-10-\ -40\mu c/g$ as measured by the method which will be described hereinafter, with very good image, and the toner scattering was very small during the experiments. This condition means that the absolute value of the amount of charge is not less than 10 $\mu c/g$ and not more than 40 $\mu c/g$. Within this range, the charge amount of not less than 20 $\mu c/g$ in the absolute value is particularly preferable.

It has been found that when the toner having a great amount of charge described above is used, the toner particles having an extremely high amount of charge is deposited on the carrier particles when the number of image formation sheets is increased. Such toner particles are not contributable to the developing operation. This relatively occurs in the continuous operation and other severe operating conditions. When the frequency of the alternating voltage component of the developing bias is 1.8−2.2 KHz, and the peak-to-peak voltage thereof is 1.6−2.0 KV, it has been confirmed that sufficient developer vibrating effect can be provided during the developing operation, and therefore the problem of the toner particle deposition on the carrier particles to decrease the efficiency of the development, can be prevented.

As will be understood, the high quality images can be provided during the continuous durability test operation for a long period of time, better than the above-described two embodiments.

The tolerance to the material of the developer can be increased.

Figure 8:
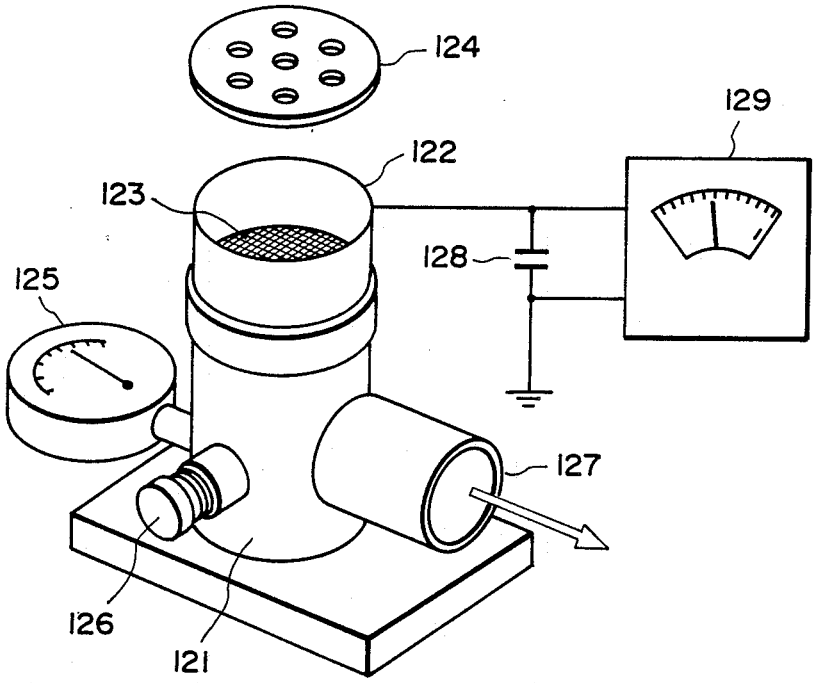
FIG. 8 is a perspective view illustrating method of measuring amount of charge of the toner.

The method of measurement of the triboelectric charge of the toner will be described. FIG. 8 illustrates a device for measuring the amount of charge of the toner. A mixture of toner and carrier at the weight ratio of 1:9 to be measured is contained in a polyethylene resin bin having a capacity of 50–100 ml, and is vibrated by hand for about 20 seconds, and approximately 0.5−1.5 g of the mixture developer is transferred into a measuring container 122 of a metal having a 500 mesh screen 123 at the bottom, and the container is closed by a metal cover 124. Then, the entire weight $W_1$ (g) of the measuring container 122 is measured. The toner is sucked by a sucking machine 121 mounted to the sucking opening 127. At least the part of the sucking machine 121 contactable to the measuring container 122 is of an insulating material. A control valve 126 is adjusted to provide the pressure of 250 mAq in the vacuum gauge. In this state, the sucking operation is performed sufficiently, preferably, for two minute to remove the toner. The potential indicated on the potentiometer 129 is V. A capacity 128 has a capacitance C ($\mu$F). After the sucking, the entire weight $W_2$ (g) of the measuring container is measured. The triboelectric charge amount of the toner ($\mu c/g$) is measured as follows:

$$(C \times V)/(W_1 - W_2)\ (\mu c/g)$$

The measurement is effected at 23°C. and 60% relative humidity.

Figure 9:
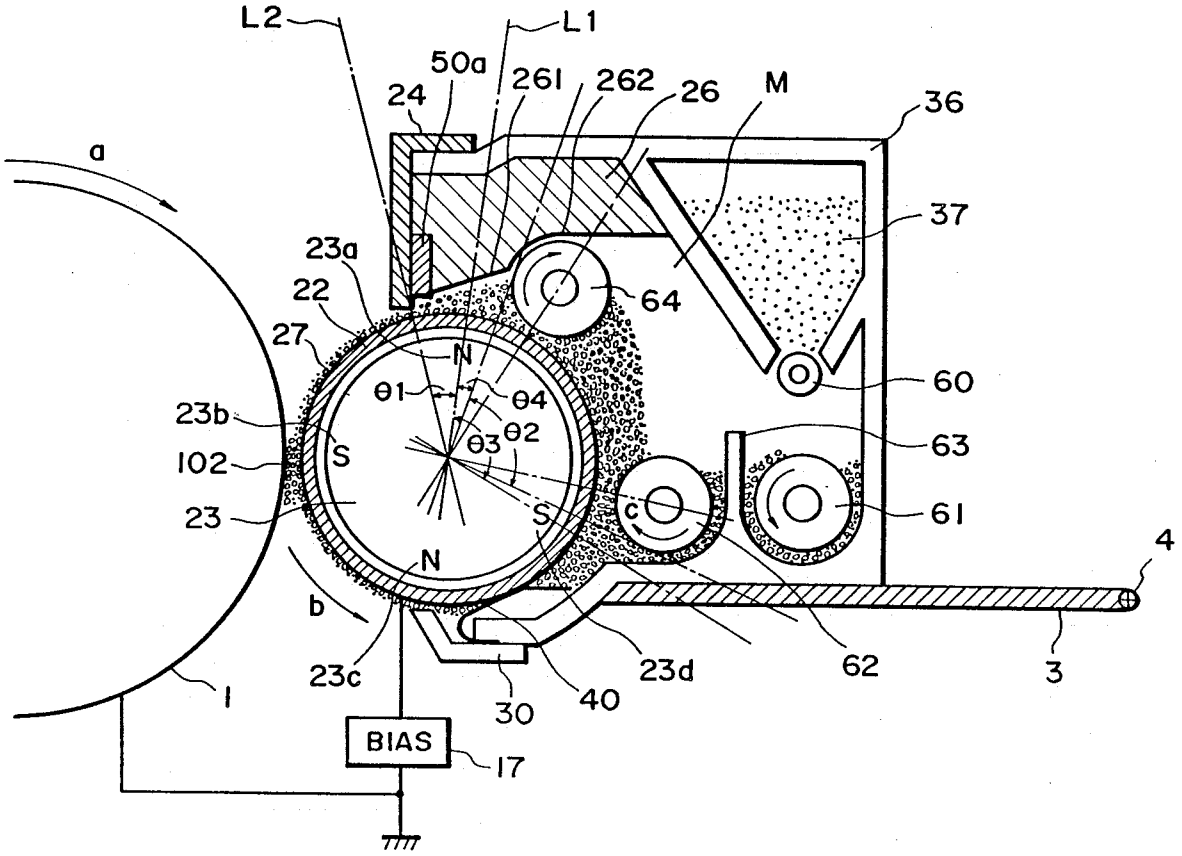
FIG. 9 is a sectional view of a developing device according to a further embodiment of the present invention.

Referring to FIG. 9, there is shown a further preferable modified embodiment of FIG. 6 device.

In this embodiment, the magnetic member **50*a* of ferromagnetic material such as iron or nickel has a small width. In this case, the magnetic field by the magnetic pole 23*a* is not very strongly concentrated locally on the sleeve side edge of the magnetic member 50*a***, but the magnetic field is also concentrated on the side surface (magnetic field concentrating surface). By this, the difference between the concentrated magnetic field to the edge portion and the magnetic field concentrated on the side surface is reduced, so that a concentrated magnetic field in which the density of the magnetic lines of force is relatively sparse and relatively uniform. By such a concentrated magnetic field, the developer layer in the regulating station is relatively in the sparse state, and the deterioration of the toner is prevented, and in addition, the amount of the charge of the toner can be made proper, by which the decrease of the image density can be prevented. In addition, the thickness of the developer layer is further improved.

It is preferable that the angle formed between the side surface (magnetic field concentrating surface) of the magnetic member **50*a* and a line normal to the sleeve surface and passing through the edge of the magnetic member 50*a* is preferably not less than −45 degrees and not more than 60 degrees. Here, the negative of the angle means that the magnetic field concentrating surface is inclined downstream with respect to the sleeve rotation direction from the normal line. The angle may be larger than 0 degree. The width of the magnetic members 50*a* measured in the direction perpendicular to the developer conveying direction, that is, the width of the magnetic field concentrating surface is preferably not less than 1 mm and not more than 10 mm. This has been empirically confirmed. If the width is not less than 2.5 mm and not more than 7 mm, more uniform magnetic field concentration on this surface of the magnetic member can be achieved. The thickness of the magnetic member 50*a*** is not less than 0.2 mm and not more than 3 mm, preferably not less than 0.5 mm and not more than 2.0 mm.

According to the inventors, the magnetic member **50*a* of this embodiment has an advantage in addition to the uniform magnetic field concentration. In the conventional structure, a long magnetic blade is effective to block the influence of the magnetic field to the outside of the portion containing the developer, but in the apparatus of FIG. 9, the magnetic field provided by the magnetic pole 23*a* is positively used to influence the magnetic field generating portion 23*b* through the magnetic member 50*a***, by which the developer conveyed out of the regulating station is stabilized, and the conveyance of the developer after the regulating can be improved.

In each of the above-described embodiments, the distance between the magnetic pole **23*a* and the magnetic pole 23*d*, is relatively large in order to decrease the conveying force to the developer so as to sufficiently mix the developer. If, however the conveying force is decreased too much, the collected developer is prevented from returning into the container with the result that the developer stagnated at the bottom of the developing device. According to the experiments, if additional conveying pole is formed between the magnetic pole 23a and the magnetic pole 23d**, the conveying force becomes so strong that the developer is not sufficiently stirred and reaches the regulating station, with the result of image density non-uniformness. This means, in effect, that the region in which the fresh developer and the collected developer on the sleeve are exchanged is enlarged beyond necessity, and therefore, the mixing and stirring region of the developer on the sleeve in the conveying passage after the exchange is reduced. Therefore, the triboelectric charge on the toner is not uniformly enhanced.

A developing device of a commercial electrophotographic copying machine of an ordinary type wherein the outer diameter of the developing sleeve is 9–30 mm, requires not less than 90 degrees, preferably not less than 100 degrees of the distance between the magnetic poles 23a and 23d. Further, in order to prevent the stagnation at the bottom of the developer, the angle $\theta 3$ is within 160 degrees, preferably 150 degrees. In each of the above-described embodiments, $\theta 3$ is 130 degrees. As regards the positional relation between the magnetic pole 23d and the screw 62, the screw 62 is preferably downstream of the magnetic pole 23d with respect to the rotational direction of the sleeve.

If the screw 62 is disposed upstream of the magnetic pole 23d, a magnetic brush of the magnetic particles is formed adjacent the magnetic pole 23d, and the magnetic brush easily takes the fresh developer conveyed by the screw 62 into the magnetic brush. Therefore, the region for the exchange between the collected developer and the fresh developer is enlarged in effect with the result of reduction of the stirring and mixing region in the conveying passage after the exchange. This increases the tendency of production of non-uniform image. Also, the conveying force to the developer between the magnetic poles 23d and 23c decreases to promote the stagnation of the collected developer adjacent the bottom of the developing device. This is because the conveying force at the downstream portion by the magnetic poles 23d and 23a is set lower, and the conveying force at the upstream of the magnetic pole 23d is influenced thereby to be decreased, and therefore, the developer stagnates if a member such as a screw disposed adjacent the sleeve. Further, if the screw 62 is disposed upstream of the magnetic pole 23d, the fresh developer is taken from the brush of the magnetic particles, and therefore, a sleeve ghost is easily produced in addition to the disadvantage of the non-uniform image. If, on the contrary, the screw 62 is disposed at the downstream side of the magnetic pole 23d with the rotational direction of the sleeve, the mixing and stirring action between the collected developer and the fresh developer takes place between the sleeve 22 and the screw 62, and the developer is moved by the screw 62 along the length of the sleeve, by which the exchange of the developers on the sleeve is sufficiently performed. Accordingly, the non-uniform image and the occurrence of the sleeve ghost are prevented.

The clearance between the screw 62 and the sleeve 22 is preferably 1–5 mm, and if it is too large, the exchange of the developers is deteriorated. In this embodiment, it is 3 mm. A conveying screw 64 is effective to make uniform the amount of the developer along the length of the developing sleeve. Also, the stirring and conveying action of the screw 64 to the developer improves the amount of the triboelectric charge of the toner.

More particularly, the screw 64 is effective to uniformize along the length of the developing sleeve the amount of the developer conveyed to the regulating station and the triboelectric charge of the toner immediately before the inlet of the regulating station. If the amount of the developer and the triboelectric charge of the toner conveyed to the regulating station varies significantly, the variation is further promoted by the packing of the developer at the regulating station with the result that the thickness of the developer layer on the sleeve after the regulation is not uniform, leading to non-uniform image density. The position of the screw 64 is preferably upstream of the magnetic pole 23a with respect to the rotational direction of the sleeve, and is preferably in a downstream half of the developer conveying passage between the magnetic pole 23a to the magnetic pole 23d. This is effective to maintain a predetermined high dense state of the developer conveyed to the regulating station, by which the packed state in the regulating station described above is made further easier. If it is disposed in the former half, the uniformizing action in the longitudinal direction is sometimes slightly decreased. Also, the promotion of formation of the packed state in the regulating station described above is disabled. Additionally, the distance from the screw 62 is decreased with the result that the region for exchanging the fresh developer and the collected developer by the screw 62 is enlarged beyond necessity, and that the developer mixing and stirring region on the sleeve in the conveying passage after the exchange is reduced. Therefore, it becomes difficult that the triboelectric charge of the toner particles is uniformly increased. An angle $\theta 4$ between the magnetic pole 23a and an outer periphery of the screw 64 as seen from the rotational center of the sleeve is preferably 0–40 degrees. If the influence of the magnetic force provided by the magnetic pole 23a is disabled, the conveyance of the developer in the longitudinal direction of the sleeve is deteriorated, and therefore, the screw 64 is disposed within the influence of the magnetic pole 23a.

If the magnetic force of the magnetic pole 23d is too strong, the amount of the developer present on the sleeve from the screw 64 to the regulating station decreases, so that the developer regulating function and effect in this region can not be expected, with the result that the uniform application of the developer is difficult. Also, the conveyance in the longitudinal direction by the screw 64 is worsened, resulting in reduction of the uniformization by the screw 64 along the longitudinal direction of the sleeve. Therefore, it is preferable that the magnetic force of the magnetic pole 23d is smaller than that of the magnetic pole 23a, and that the amount of the developer in the region is made relatively larger.

In each of the foregoing embodiments, the screws 62 and 64, in other words, the maximum stirring region by the member 62 and the maximum stirring region by the member 64, are all within an angle $\theta 3$ which is formed between the maximum magnetic flux density point in the magnetic field formed by the first stationary magnetic field generating portion 23d on the surface of the developer carrying member (sleeve) and the maximum magnetic flux density point in the magnetic field formed by the second stationary magnetic field generating portion 23a on the developer carrying member 22 surface as seen from a rotational center of the developer carrying member (sleeve) 22.

As for the material for the sleeve 22, stainless steel, electrically conductive material such as brass and aluminum, and a paper cylinder or a synthetic resin cylinder are usable. If the surface of the paper cylinder or a synthetic resin cylinder are treated with conductive material at the surface thereof or, if it is formed with conductive material, conductive part can be made to function as a developing electrode. Furthermore, a core roll may be used, and the peripheral thereof is wrapped by a conductive elastic material, such as a conductive sponge, for example. The magnetic pole 23*b* in the developing zone is disposed in the middle of the developing zone or position in the embodiments, but it may be deviated from the center, and the developing zone may be positioned between magnetic poles.

Silica particles may be added to the developer so as to enhance the fluidability. Abrasive particles may be added thereto in order to abrade properly the surface of the photosensitive drum 1 functioning as the latent image bearing member, in an image transfer type image forming process. A small amount of magnetic particles may be added to the toner. If the magnetic property is weaker than the magnetic carrier particles, and the triboelectric charging is possible, magnetic toner can be used.

In the embodiments, the average particle size of the toner particles is approximately 10 microns. However, according to the present invention, the good image can be provided even if the toner particles having the average particle size of 3–10 microns is used.

In order to prevent production of a ghost image, the layer of the developer remaining on the sleeve 22 without being consumed for the development and returned into the container 21, may be once scraped off the sleeve 22 by an unshown scraper means, and the scraped sleeve surface may be contacted to the magnetic particle layer to apply again the developer on the sleeve.

The developing device according to the present invention is not limited to the application to a rotary type multi-color developing apparatus as in the foregoing embodiments, but is applicable to a disposable developing device containing the sleeve 22 and the blade 24 as a unit, and is applicable to a process cartridge in which the developing device, a photosensitive drum and/or a cleaning device are integrally contained. Also, it is applicable to a developing device fixed in a monochromatic image forming apparatus, or to stationary developing devices in a multi-color image forming device.

In the foregoing embodiments, a remarkable advantageous effects are confirmed when used with a small diameter sleeve having an outer diameter of 9–25 mm. This means that the problem that the small diameter sleeve for development is greatly influenced by the change in the ambience, is solved at once, and therefore, a developing device in which the change in the image density is small, and wherein a stabilized developing operation without decrease of the image density can be performed for a long period even under a low humidity condition, using two component developer, can be provided with the advantage of the small size developing device While the invention has been described with reference to the structures disclosed herein, it is not confined to the details set forth and this application is intended to cover such modifications or changes as may come within the purposes of the improvements or the scope of the following claims.

What is claimed is:

1. A reverse developing method for depositing toner particles on a light potential area of an electrostatic image formed on an image bearing member, comprising:

forming a layer of a developer on a developer carrying member behind which magnetic field generating means is disposed, the developer including the toner particles and magnetic carrier particles for charging the toner particles to a polarity which is the same as a polarity of a dark potential of the image bearing member;

carrying the developer layer to a developing position where the developer carrying member and the image bearing member are opposed, and forming an alternating electric field in the developing position;

wherein a relative volumetric ratio Q (%) of the magnetic carrier particles in the developing position satisfies:

$$15.0 \leqq Q \leqq 28.0.$$

2. A method according to claim 1, wherein the developer layer carried on the developer carrying member is contacted to the image bearing member in the developing position.

3. A method according to claim 2, wherein a ratio $\sigma$ the peripheral speed of the developer carrying member to the peripheral speed of the image bearing member satisfies:

$$1.0 < \sigma \leqq 1.75.$$

4. A method according to claim 2, wherein a maximum strength F of the alternating electric field relative to the light potential area of the image bearing member satisfies:

$$2.07 \leqq F \leqq 3.00.$$

5. A method according to claim 4, wherein a voltage $V_{DC}$ of a DC component of the alternating electric field and the dark potential $V_D$ of the image bearing member satisfy:

$$50(V) \leqq |V_{DC} - V_D| \leqq 200(V).$$

6. A method according to claim 2, wherein a thickness of the developer layer is regulated by a non-magnetic member disposed opposed to the developer carrying member within an influence of a magnetic field formed by the magnetic field generating means, and wherein a clearance between the non-magnetic member and the developer carrying member is 50–900 microns.

7. A method according to any one of claims 1-6 and 33 wherein a resistivity of the magnetic carrier particles is not less than $10^7$ ohm.cm.

8. A color image forming method, comprising:

forming sequentially developed images in different colors by repeating reverse development for depositing toner particles on a light potential area of an electrostatic latent image formed on an image bearing member, said reverse development including, forming a layer of a developer on a developer carrying member behind which magnetic field generating means is disposed, the developer including the toner particles and magnetic carrier particles for charging the toner particles to a polarity which is the same as a polarity of a dark potential of the image bearing member;

carrying the developer layer to a developing position where the developer carrying member and the image bearing member are opposed; and forming an alternating electric field in the developing position;

wherein a relative volumetric ratio Q (%) of the magnetic carrier particles in the developing position satisfies:

$$15.0 \leqq Q \leqq 28.0; \text{ and}$$

superimposing the plural color developed images.

9. A developing method according to claim 8, wherein the developer layer carried on the developer carrying member is contacted to the image bearing member in the developing position.

10. A method according to claim 9, wherein a ratio $\sigma$ the peripheral speed of the developer carrying member to the peripheral speed of the image bearing member satisfies:

$$1.0 < \sigma \leqq 1.75.$$

11. A method according to claim 9, wherein a maximum strength F of the alternating electric field relative to the light potential area of the image bearing member satisfies:

$$2.07 \leqq F \leqq 3.00.$$

12. A method according to claim 11, wherein a voltage $V_{DC}$ of a DC component of the alternating electric field and the dark potential $V_D$ of the image bearing member satisfy:

$$50(V) \leqq |V_{DC} - V_C| \leqq 200(V).$$

13. A method according to claim 9, wherein a thickness of the developer layer is regulated by a non-magnetic member disposed opposed to the developer carrying member within an influence of a magnetic field formed by the magnetic field generating means, and wherein a clearance between the non-magnetic member and the developer carrying member is 50–900 microns.

14. A method according to any one of claims 8-13 wherein a resistivity of the magnetic carrier particles is not less than $10^7$ ohm.cm.

15. A method according to claim 2, wherein in said developing position, chains of magnetic carrier particles erecting toward the image bearing member is formed on the developer carrying member by the magnetic field generating means, and wherein the toner particles are retained on the surfaces of the magnetic carrier particles and the surface of the developer carrying member, and the toner particles on both of the surfaces are deposited on the light potential area.

16. A method according to claim 7, wherein the magnetic carrier particles have a resistivity of not more than $10^{12}$ ohm.cm.

17. A method according to claim 16, wherein the magnetic carrier particles have an average particle size of 30–100 microns.

18. A method according to claim 16, wherein an amount of charge of the toner particles is not less than 10 micro-Coulomb/g and not more than 40 micro-Coulomb/g.

19. A method according to claim 4, wherein a frequency of the alternating electric field is not less than 1.8 KHz and not more than 2.2 KHz.

20. A method according to any one of claims 1–7 and 15, wherein said developer carrying member is in the form of a sleeve having a diameter of 9–25 mm.

21. A method according to claim 9, wherein said developing position, chains of magnetic carrier particles erecting toward the image bearing member is formed on the developer carrying member by the magnetic field generating means, and wherein the toner particles are retained on the surfaces of the magnetic carrier particles and the surface of the developer carrying member, and the toner particles on both of the surfaces are deposited on the light potential area.

22. A method according to claim 14, wherein the magnetic carrier particles have a resistivity of not more than $10^{12}$ ohm.cm.

23. A method according to claim 22, wherein the magnetic carrier particles have an average particle size of 30–100 microns.

24. A method according to claim 22, wherein an amount of charge of the toner particles is not less than 10 micro-coulomb/g and not more than 40 micro-Coulomb/g.

25. A method according to claim 11, wherein a frequency of the alternating electric field is not less than 1.8 KHz and not more than 2.2 KHz.

26. A method according to any one of claims 8-13 and 21, wherein said developer carrying member is in the form of a sleeve having a diameter of 9–25 mm.

27. A method according to any one of claims 8-13 and 21, wherein the electrostatic images in the respective colors are formed by scanning the image bearing member the laser beam modulated in accordance with pieces of image information corresponding to the colors.

28. A method according to any one of claims 8-13 and 21, wherein the developed images are transferred onto the same transfer material, sequentially.

* * * * *

UNITED STATES PATENT AND TRADEMARK OFFICE

CERTIFICATE OF CORRECTION

PATENT NO. : 4,954,404

DATED : September 4, 1990

INVENTOR(S) : MASAHIRO INOUE ET AL.

It is certified that error appears in the above-identified patent and that said Letters Patent is hereby corrected as shown below:

SHEET 3 OF 6

FIG. 4, "CARIER" should read --CARRIER--.

COLUMN 1

Line 32, "publications" should read --publication-- and "deal" should read --deals--.
Line 33, "to" should be deleted.

COLUMN 3

Line 7, "disclosed" should read--disclosed in--.
Line 15, contains" should read --contain--.

COLUMN 4

Line 52, "electromagnetic" should read --electromagnet--.

COLUMN 5

Line 5, "sleeve 2 another" should read --sleeve 2. Another--.

COLUMN 6

Line 50, "the θ1" should read --the angle θ1--.

COLUMN 7

Line 23, "sleeve 22 closest," should read --sleeve 22 are closest,--.

UNITED STATES PATENT AND TRADEMARK OFFICE

CERTIFICATE OF CORRECTION

PATENT NO. : 4,954,404

DATED : September 4, 1990

INVENTOR(S) : MASAHIRO INOUE ET AL.

It is certified that error appears in the above-identified patent and that said Letters Patent is hereby corrected as shown below:

COLUMN 10

Line 65, "represent" should read --represents--.

COLUMN 11

Line 28, "the 15.0≦=Q≦28.0" should read --15.0≦Q≦28.0--.

COLUMN 13

Line 40, "deteriorate" should read --deteriorates--.

COLUMN 16

Line 30, "resistance carrier" should read --resistance and carrier--.
Line 31, "is" should read --are--.
Line 39, "conditions" should read --condition--.
Line 53, "conditions are" should read --condition is--.
Line 56, "is" should read --are--.

COLUMN 18

Line 1, "capacity 128" should read --capacitor 128--.

COLUMN 21

Line 52, "a" should be deleted.

UNITED STATES PATENT AND TRADEMARK OFFICE

CERTIFICATE OF CORRECTION

PATENT NO. : 4,954,404

DATED : September 4, 1990

INVENTOR(S) : MASAHIRO INOUE ET AL.

It is certified that error appears in the above-identified patent and that said Letters Patent is hereby corrected as shown below:

COLUMN 22

Line 30, "σthe" should read --σ the--.
Line 56, "33" should read --15--.

COLUMN 23

Line 37, "$50(V) \leqq |V_{DC}-V_C| \leqq 200(V)$." should read --$50(V) \leqq |V_{DC}-V_D| \leqq 200(V)$.--.
Line 47, "claims 8-13" should read --claims 8-13 and 21--.
Line 52, "is" should read --are--.

COLUMN 24

Line 21, "wherein said" should read --wherein in said--.
Line 23, "is" should read --are--.
Line 49, "ber the" should read --ber with the--.

Signed and Sealed this

Eleventh Day of August, 1992

*Attest:*

DOUGLAS B. COMER

*Attesting Officer*

*Acting Commissioner of Patents and Trademarks*